US008308574B2

(12) United States Patent
Burke et al.

(10) Patent No.: US 8,308,574 B2
(45) Date of Patent: Nov. 13, 2012

(54) MANAGING GAMES IN WAGERING GAMING NETWORKS

(75) Inventors: Mary M. Burke, Somonauk, IL (US); James E. Oatman, Arlington Heights, IL (US); Jacqueline F. Parra, Glen Ellyn, IL (US)

(73) Assignee: WMS Gaming, Inc., Waukegan, IL (US)

( * ) Notice: Subject to any disclaimer, the term of this patent is extended or adjusted under 35 U.S.C. 154(b) by 0 days.

(21) Appl. No.: 13/129,306

(22) PCT Filed: Nov. 13, 2009

(86) PCT No.: PCT/US2009/064482

§ 371 (c)(1), (2), (4) Date: May 27, 2011

(87) PCT Pub. No.: WO2010/057058

PCT Pub. Date: May 20, 2010

(65) Prior Publication Data

US 2011/0224002 A1 Sep. 15, 2011

Related U.S. Application Data

(60) Provisional application No. 61/114,815, filed on Nov. 14, 2008.

(51) Int. Cl.
*A63F 9/24* (2006.01)

(52) U.S. Cl. ..... 463/42; 463/29; 463/20; 463/30; 463/17; 463/25; 705/1; 273/139

(58) Field of Classification Search ..... None
See application file for complete search history.

(56) References Cited

U.S. PATENT DOCUMENTS

2006/0259318 A1* 11/2006 Walker et al. ..... 705/1

FOREIGN PATENT DOCUMENTS

| | | |
|---|---|---|
| WO | WO 2007087297 | 8/2007 |
| WO | WO 2007087297 A2 * | 8/2007 |
| WO | WO 2008005298 | 1/2008 |
| WO | WO 2008005298 A2 * | 1/2008 |
| WO | WO 2008039403 | 4/2008 |

(Continued)

OTHER PUBLICATIONS

"PCT Application No. PCT/US09/64482 International Preliminary Report on Patentability", Mar. 14, 2011 , 13 pages.

(Continued)

*Primary Examiner* — Paul A. D'Agostino
(74) *Attorney, Agent, or Firm* — DeLizio Gilliam, PLLC

(57) ABSTRACT

Some embodiments of the inventive subject matter include one or more machine readable media including instructions which when executed by a machine cause the machine to perform operations comprising: loading, into a main memory of the machine, a wagering game software program configured to, upon execution, determine results for wagering games and to provide the results to remote wagering game terminals; executing the wagering game software program in the machine; deactivating the wagering game software program, wherein the deactivating includes, for each one of the wagering game terminals, determining that the one of the wagering game terminals has been idle for a specified time period; discontinuing determination of the results and provision of the results to the one of the wagering game terminals; and ceasing execution of the wagering game software.

20 Claims, 8 Drawing Sheets

FOREIGN PATENT DOCUMENTS

| | | | |
|---|---|---|---|
| WO | WO 2008039403 | A2 * | 4/2008 |
| WO | WO 2008103324 | | 8/2008 |
| WO | WO 2008103324 | A1 * | 8/2008 |
| WO | WO 2008106404 | | 9/2008 |
| WO | WO 2008106404 | A2 * | 9/2008 |
| WO | WO 2010057058 | | 5/2010 |

OTHER PUBLICATIONS

"PCT Application No. PCT/US09/64482 International Search Report", Jan. 29, 2010 , 11 pages.

* cited by examiner

MANAGING GAMES IN WAGERING GAMING NETWORKS

RELATED APPLICATIONS

This application claims the priority benefit of U.S. Provisional Application Ser. No. 61/114,815 filed Nov. 14, 2008.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2009, WMS Gaming, Inc.

FIELD

Embodiments of the inventive subject matter relate generally to wagering game systems, and more particularly to managing wagering games in distributed wagering game networks.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

SUMMARY

In some embodiments, a computer-implemented method for managing computerized wagering games in a wagering game network comprises selecting a group of wagering game terminals on which to present wagering games; activating, in a wagering game server, a wagering game unit to present the wagering games on the wagering game terminals; determining at least one event that must occur at each of the wagering game terminals before the wagering games are unavailable; detecting, in the wagering game server, an indication to deactivate the wagering game unit; determining that the at least one event occurred at certain of the wagering game terminals; ceasing presentation of the wagering games on the certain wagering game terminals; determining that the at least one event occurred at others of the wagering game terminals; ceasing presentation of the wagering games on the others of the wagering game terminals; deactivating, on the wagering game server, the wagering game unit.

In some embodiments, the at least one event indicates that one of the wagering game terminals has been idle for a specified time period.

In some embodiments, the at least one event indicates that one of the wagering game terminals has been idle for a specified time period and with no credits on a credit meter.

In some embodiments, the group of wagering game terminals is selected based on user input through a graphical user interface.

In some embodiments, the deactivating removes the wagering game unit from main memory in the wagering game server.

In some embodiments, the activating the wagering game unit causes the wagering game server to load the wagering game unit into main memory and to perform operations under control of the wagering game unit.

In some embodiments, one or more machine readable media including instructions which when executed by a machine cause the machine to perform operations comprises loading, into a main memory of the machine, a wagering game software program configured to, upon execution, determine results for wagering games and to provide the results to remote wagering game terminals. The operations can also comprise executing the wagering game software program in the machine, and deactivating the wagering game software program, wherein the deactivating includes, for each one of the wagering game terminals. The operations can also comprise determining that the one of the wagering game terminals has been idle for a specified time period, discontinuing determination of the results and provision of the results to the one of the wagering game terminals, and ceasing execution of the wagering game software.

In some embodiments, the operations further comprise loading into the main memory of the machine, another wagering game software program configured to, upon execution, determine other results for other wagering games and to provide the other results to the remote wagering game terminals; and executing the wagering game software program in the machine.

In some embodiments, the operations further comprise receiving user input indicating selection of the wagering game terminals from a larger group of wagering game terminals.

In some embodiments, a duration of the specified time period is selected based on regulatory regulations.

In some embodiments, the operations further include: receiving user input indicating a condition which when satisfied indicates that the wagering game software should be terminated; detecting the condition is satisfied.

In some embodiments, an apparatus comprises a random number generator configured to generate random numbers for use in determining results for wagering games; a wagering game unit configured to, when activated, determine the results for the wagering games based on the random numbers, and to provide the results to remote wagering game terminals; a gaming coordinator including, a user interface controller configured to receive user input indicating a first event that triggers a process for deactivating the wagering game unit, the input also indicating a second event; an activation controller configured to activate the wagering game unit; commence deactivation of the wagering game unit after detection of the first event; discontinue provision of the results for each of the terminals at which the second event is detected; and terminate operation of the wagering game unit after detection of the second event at all the terminals.

In some embodiments, the second event is an idle time period.

In some embodiments, the first event is user input directing immediate deactivation of the wagering game unit, a time of day, or coin-in associated with the wagering games.

In some embodiments, the activation controller is further configured to reclaim processing resources allocated to the wagering game unit.

In some embodiments, the activation controller is further configured to evict machine-readable instructions of the wagering game unit from a main memory.

In some embodiments, a machine readable medium including instructions executable by a machine, the instructions comprises instructions to present an interface including options for configuring a process for deactivating a wagering game unit, wherein the wagering game unit is configured to provide remote wagering game terminals with results for wagering games; instructions to detect user input indicating selection of one or more of the options, wherein in the options indicate conditions that when satisfied trigger the process for deactivating the wagering game unit, and wherein the options specify a time of day, an idle time, and a credit meter balance; instructions to perform the process for deactivating the wagering game unit, wherein the instructions to perform the process include, instructions to determine that one or more of the conditions have been satisfied, wherein some of the conditions are associated with activities at the wagering game terminals; and instructions to stop the providing of the results to the remote wagering game terminals.

In some embodiments, the options further indicate another wagering game unit to activate, and wherein the instructions further comprise instructions to activate the other wagering game unit, wherein upon activation the other wager game unit is configured to provide results to one or more of the wagering game terminals.

In some embodiments, the instructions to perform the process for deactivating the wagering game unit include instructions to revoke processing resources from the wagering game unit and to evict the wagering game unit from a main memory.

In some embodiments, the instructions to perform the process for deactivating the wagering game unit include instructions to receive approval from a regulatory authority.

In some embodiments, an apparatus comprises means for selecting a group of wagering game terminals on which to present wagering games; means for activating, in a wagering game server, a wagering game unit to present the wagering games on the wagering game terminals; means for determining at least one event that must occur at each of the wagering game terminals before the wagering games are unavailable; means for detecting, in the wagering game server, an indication to deactivate the wagering game unit; means for determining that the at least one event occurred at certain of the wagering game terminals; means for ceasing presentation of the wagering games on the certain wagering game terminals; means for determining that the at least one event occurred at others of the wagering game terminals; means for ceasing presentation of the wagering games on the others of the wagering game terminals; means for deactivating, on the wagering game server, the wagering game unit.

In some embodiments, the at least one event indicates that one of the wagering game terminals has been idle for a specified time period.

In some embodiments, the at least one event indicates that one of the wagering game terminals has been idle for a specified time period and with no credits on a credit meter.

In some embodiments, the group of wagering game terminals is selected based on user input through a graphical user interface.

In some embodiments, the deactivating removes the wagering game unit from main memory in the wagering game server.

BRIEF DESCRIPTION OF THE FIGURES

Embodiments of the invention are illustrated in the Figures of the accompanying drawings in which.

DESCRIPTION OF THE EMBODIMENTS

Figure 1:
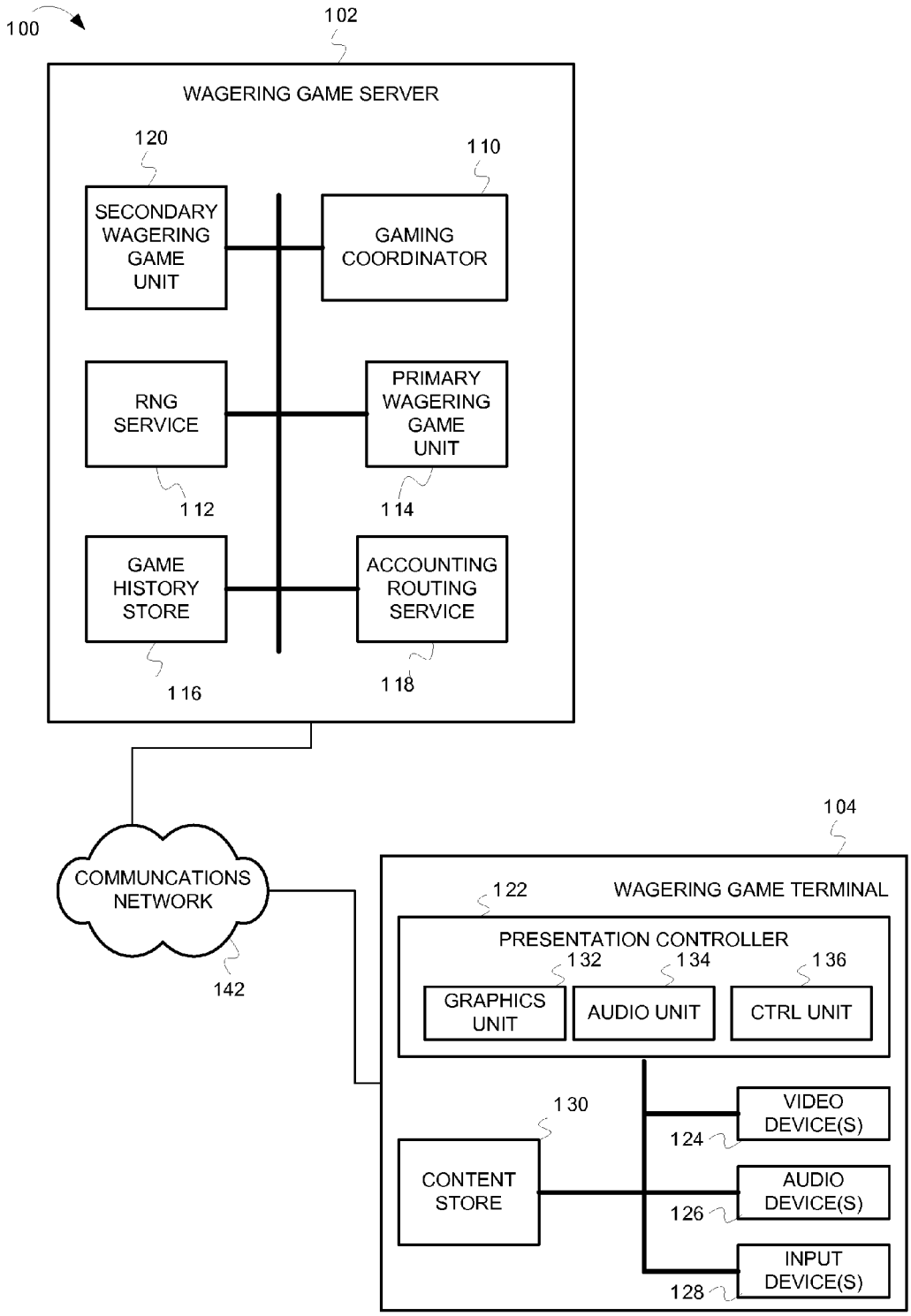
FIG. 1 is a block diagram illustrating a wagering game network for presenting wagering games, according to some embodiments of the invention.

This description of the embodiments is divided into five sections. The first section provides an introduction to embodiments of the invention, while the second section describes example wagering game machine architectures. The third section describes example operations performed by some embodiments and the fourth section describes example wagering game machines in more detail. The fifth section presents some general comments.

Introduction

This section provides an introduction to some embodiments of the inventive subject matter.

In some wagering game networks, wagering game servers host games that are presented on client terminals. Each wagering game server can include a plurality of wagering game programs, where each program facilitates a different wagering game. For example, a server may include three wagering game programs: one for slots, another for video poker, and yet another for video blackjack. According to some embodiments, casino managers can configure the server to present different games on different terminals. For example, casino managers may configure the server to present slots on some terminals, and video poker on the remaining terminals (no terminals presenting video blackjack). In turn, the wagering game server can launch and execute the slots and video poker programs. While executing the programs, the server can facilitate slots and poker games by providing game results and other content to the terminals.

As casino conditions change (e.g., the number of players, player demographics, etc.), casino managers may want to reconfigure the wagering game server to offer different games or configuration options (e.g., pay tables, denominations, etc.). Thus, casino managers may want to terminate one wagering game program and initiate another wagering game program (e.g., terminate video poker and launch video blackjack). When the server terminates a wagering game program, the corresponding wagering game is no longer available on the terminals. In some situations, casino managers may want certain events to occur before a wagering game is unavailable at the terminals. In some embodiments, the server can determine whether certain events have occurred before making a game unavailable to a particular terminal. For example, if casino managers want each terminal to be idle (i.e., no players playing games) for five minutes before a game becomes unavailable, the server can check a terminal's idle time before making a game unavailable to the terminal. After the game is unavailable to all terminals, the server can complete the termination process by reclaiming resources allocated to the wagering game program (e.g., the server can stop executing the program, evict the program from main memory, etc.).

In some embodiments, wagering game servers can check any number of user-selected conditions during the process for terminating wagering game programs. For example, casino managers can configure servers to check the following before making a wagering game unavailable on a terminal: idle time, number of games played, amount of coin-in for a game, velocity of play, player demographics, etc. After the user-selected conditions are met for a terminal, the server can make the game unavailable on the terminal. After the game is unavailable on all terminals, the server can terminate the corresponding wagering game program.

Although FIG. 1 describes some embodiments, the following sections describe many other features and embodiments.

Operating Environment

This section describes an example operating environment and presents structural aspects of some embodiments. This section includes discussion about wagering game networks and devices.

FIG. 1 is a block diagram illustrating a wagering game network for presenting wagering games, according to some embodiments of the invention. In FIG. 1, the wagering game network 100 includes a communications network 142 connected to a wagering game server ("server") 102 and wagering game terminal ("terminal") 104. The communications network 142 can support wired and wireless communications, and can employ any suitable connection technology, such as Bluetooth, 802.11, Ethernet, public switched telephone networks, cellular technologies, SONET, etc. The server 102, terminal 104, and any other device can include components for communicating over the communications network 142.

In some embodiments, the server 102 hosts wagering games, while the terminal 104 presents game results and other content. In different embodiments, the tasks for presenting wagering games can be divided differently between the server 102 and terminal 104. Thus, the terminal 104 can act as a thick, thin, or intermediate client to the wagering game server 102. Although FIG. 1 shows only one terminal 104, the server 102 can interact with a plurality of terminals (e.g., banks of stationary wagering game terminals and numerous mobile terminals in one or more casinos). Also, the network 100 can include multiple servers, and in some instances, a plurality of servers can be included in one computing device.

The server 102 includes a gaming coordinator 110, random number generator service 112, game history store 116, and accounting routing service 118. The gaming coordinator 110 can configure, launch, and terminate primary wagering game units 114 and secondary wagering game units 120.

The primary wagering game unit 114 can offer a plurality of primary wagering game types (e.g., slots, poker, roulette, etc.) and themes (e.g., a movie theme, cartoon theme, etc.). Primary games may also be known as "base games." The secondary wagering game unit 120 can offer a plurality of secondary wagering games (a.k.a. bonus games). Some secondary games require players to place wagers to be eligible to win, while other secondary games do not. Moreover, some of the secondary wagering games offer progressive jackpots. In some embodiments, secondary games are triggered by events in primary games. Alternatively, secondary games may be triggered by events independent of any primary game. For example, players can buy into secondary games in which randomly selected players win progressive jackpots irrespective of any primary game. Although FIG. 1 shows only one of each of the units 114 & 120, the server 102 can, during operation, include a plurality of each unit 114 & 120.

The gaming coordinator 110 can maintain a list of the terminals with which each primary and secondary wagering game unit is operating. The primary and secondary wagering game units can process player input from terminals. The units can also provide the terminals with game results and other content for presenting wagering games. When hosting wagering games, the primary and secondary wagering game units 114 & 120 can use the random number generator service 112 to determine wagering game results. The primary and secondary wagering game units 114 & 120 can send control information to the terminal 104, where the control information indicates results for the wagering games. For example, the control information can instruct the terminal 104 to present a specific outcome for a wagering game (e.g., a certain reel combination for a slots game). In turn, the terminal 104 can present content indicting the results. In some embodiments, control information can instruct the terminal 104 to present other types of content, such as advertising, attract modes, player messages, hotel information, etc. The control information can be in any format understood by the terminal 104.

The server 102 also includes an accounting routing service 118, which can distribute information (e.g., wager amounts, winning awards, etc.) between primary and secondary wagering game units 114 & 120, an account server (not shown), and other components of the wagering game network 100.

The terminal 104 can act as a client device capable of transmitting player input to the server 102, processing control information, and rendering wagering game content. The terminal 104 includes a presentation controller 122 and a content store 130. The presentation controller 122 includes a control unit 136, graphics unit 132, and audio unit 134. The control unit 136 can process control information and request operations from the other components. In response to me control information, the graphics and audio units 132 & 134 can present content from the content store 130. For example, if the control information instructs the terminal 104 to present a specific game result, the graphics and audio units 132 & 134 present the game result using audio and graphic content in the content store 130. The control information can instruct the presentation controller 122 to present any type of information, such as game results, player messages, attract modes, advertising, hotel information, etc.

The presentation controller's graphics and audio units 132 & 134 can include audio codecs, video codecs, graphics processing engines, physics engines, and any other devices suitable for presenting audio and video content. The content store 130 can include animation data, game art (e.g., JPEG files, PCX files, etc.), audio content (e.g., MP3 files, WAV files, etc.), prerecorded video (e.g., MPEG files, AVI files, etc.), text, metadata (e.g., audio & video configuration data), etc.

The content store's content can be updated anytime. As a result, the game's look and feel can change without changing the underlying game logic. For example, the terminal 104 can download (e.g., from the server 102 or other devices) new graphics that represent playing cards in a video poker game. The video poker game will look different because the playing card graphics are different. However, the new graphics will not affect how the game is played. Updating content in the content store 130 can also change the look and feel of advertising, player messages, etc.

The terminal 104 also includes video device(s) 124, audio device(s) 126, and input device(s) 128. The video device(s) 124 can include LCD devices, plasma display devices, and other suitable display devices. The audio device(s) 126 can include audio hardware (e.g., a sound card), audio speakers, and other audio presentation devices. The input devices 128 can include a touch screen, pointing device, keyboard, and any other device suitable for providing input to the terminal 104.

When the terminal 104 initializes, it can register with the server's gaming coordinator 110 to determine what types of primary and secondary wagering games it will offer. Although not shown in FIG. 1, the terminal 104 can receive control information from other components, such as advertising servers, messaging servers, hotel information servers, etc. As a result, the terminal 104 can present content in response to control information from various sources. In some embodiments, the terminal 104 can be included in wagering game machines or other devices, such as cell phones, notebook computers, etc.

In some embodiments, each component of the wagering game server 102 and terminal 104 can include hardware, software, or a combination of hardware and software. For example, the server's primary wagering game unit 114 may be implemented as an application specific integrated circuit or field programmable gate array that cooperates with the server's other components. Alternatively, the primary wagering game unit 114 can be implemented as instructions stored on a machine-readable media (i.e., software) that execute on a processor (not shown) or other computing component in the server 102.

In some embodiments, the components of the server and terminal can be integrated or divided. Furthermore, the components may be referred to by different names (e.g., the primary and secondary wagering game units may be referred to as wagering game units, wagering game programs, wagering game hardware, etc.). Machine-readable media includes any mechanism that provides (i.e., stores and/or transmits) information in a form readable by a machine (e.g., a wagering game machine, computer, etc.). For example, tangible machine-readable media includes semiconductor read only memory (ROM), semiconductor random access memory (RAM), magnetic storage media, optical storage media, flash memory devices, etc. Machine-readable media also includes any media suitable for transmitting software over a network.

Figure 2:
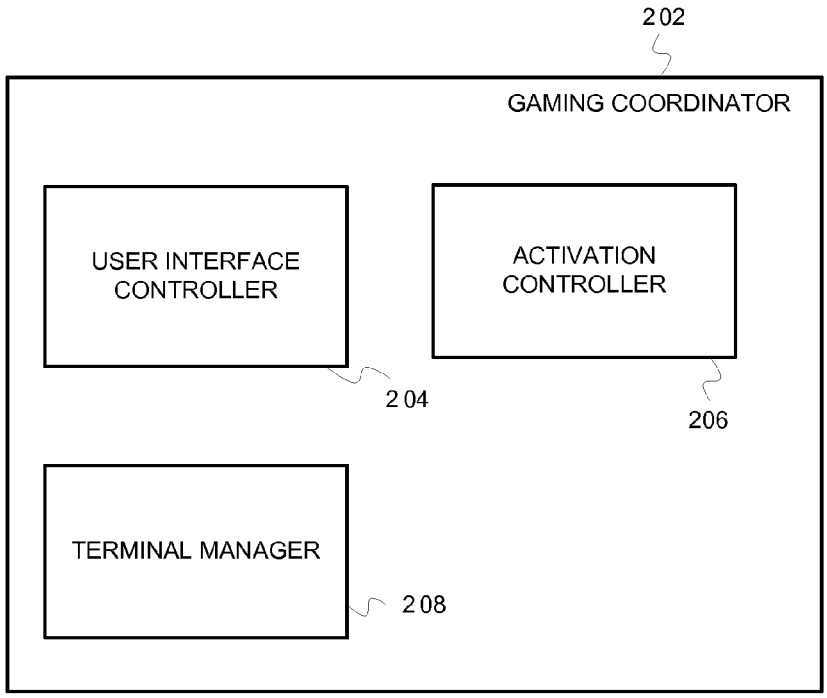
FIG. 2 is a block diagram illustrating a gaming coordinator, according to some embodiments of the invention.
Figure 3A:
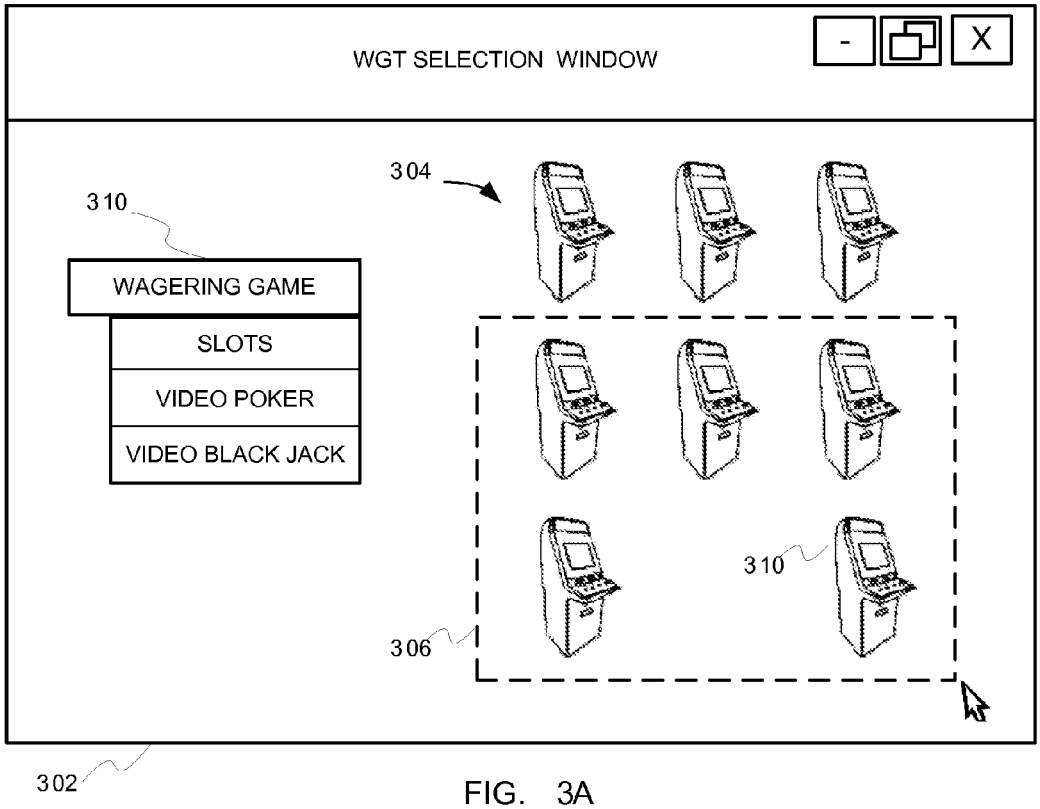
FIGS. 3A & 3B illustrate interfaces though which users can select options for activating and deactivating wagering game units.
Figure 3B:
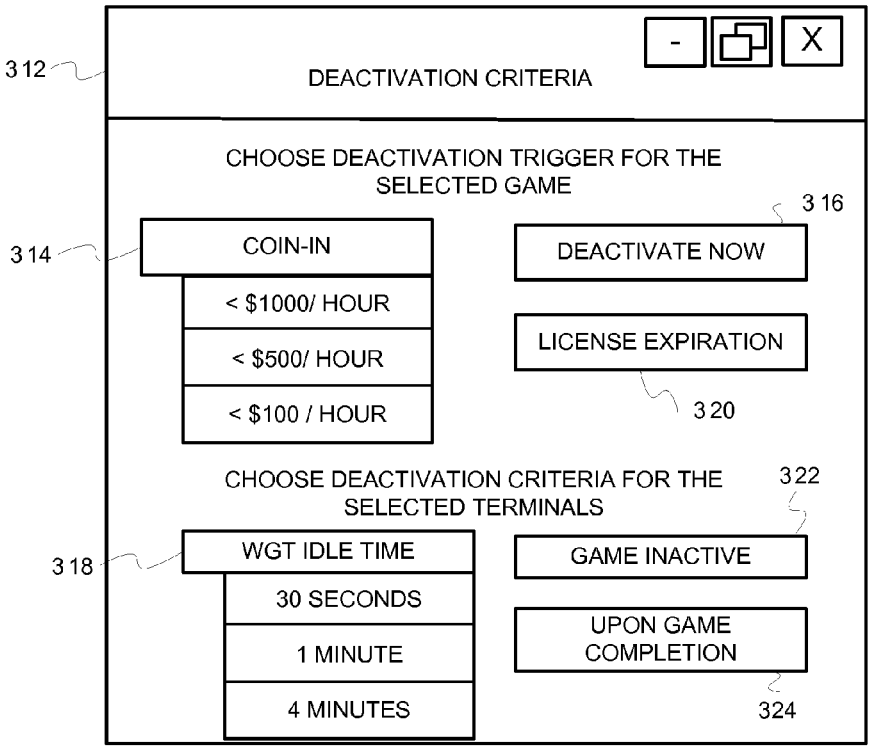

FIG. 2 is a block diagram illustrating a gaming coordinator, according to some embodiments of the invention. As noted above gaming coordinators can reside in wagering game servers. In FIG. 2, a gaming coordinator 202 includes a user interface controller 204, terminal manger 208, and activation controller 206. The user interface controller 204 can interact with users (e.g., via devices connected to the server) to determine configuration options, such as what games the server will offer to specific terminals, conditions for activating and deactivating wagering game units, etc. FIGS. 3A & 3B illustrate interfaces through which users can select options for activating and deactivating wagering game units. In FIG. 3A, a user interface 302 presents options for selecting wagering games and terminals. Users can select wagering games from the wagering game drop-down menu 310. Although the drop-down menu 310 shows a generic game names, the menus entries can identify specific games (e.g., Reel 'Em In®, Jungle Wild®, etc.), denominations (e.g., $0.25, $1.00, etc.), etc. Users can select terminals from a casino floor map 304 (i.e., see the selection box 306), where the selected terminals will present the selected wagering game.

FIG. 3B shows another interface 312 through which users can select options for deactivating wagering game units. The interface 312 includes controls for selecting events or conditions that will trigger operations for deactivating a wagering game unit that corresponds to a selected game. Users can select options from the coin-in menu 314 to trigger deactivation of a wagering game unit when coin-in (i.e., collected monetary value) associated with the selected game or other games falls below a threshold. Users can also select other conditions, such as license expiration (see button 320), etc. The "deactivate now" button 316 allows users to commence the deactivation process on-demand.

As noted above, casino managers may want to configure the deactivation process so that certain conditions occur before games become unavailable at the terminals. For instance, casino managers may want terminals associated with a game to be idle for a given time period before the game becomes unavailable. Alternatively, casino managers may want a wagering game unit itself to be idle for a given time, irrespective of activities at the terminals. The interface 312 allows users to select conditions that must occur before the server makes the game unavailable. Using the menu 318, users can configure the deactivation process to check for particular idle times at terminals associated with a game. The menu 322 can configure the deactivation process to require that a game be inactive on a terminal (e.g., a player selects a different game), whereas the menu 324 can configure the process to make a game unavailable after the current instance of the game completes on the terminal.

The interface controller 204 is not limited to the options shown in FIGS. 3A & 3B. For example, the interface controller 204 can present options for configuring operations for activating wagering game units. The interfaces can also include any suitable configuration options, such as options related to player demographics, velocity of play, game selection, wagering game terminal configuration, time of day, etc. In some embodiments, the interface controller 204 enables users to select a multitude of options. Users can indicate whether all conditions must be satisfied to trigger the deactivation process or whether fewer than all can trigger deactivation.

In some embodiments, the interface includes options for configuring an activation controller to obtain regulatory approval before deactivating wagering game units. Under such a configuration, after conditions for deactivation are satisfied (e.g., coin-in and idle time), the interface controller can present an interface through which a regulator can give approval for deactivating a wagering game unit. While the interfaces facilitate configuration of the deactivation process, the process can be configured through other techniques (e.g., command prompt, script file, etc.).

The activation controller 206 can activate and deactivate wagering game units according to user-specified conditions and default conditions. For embodiments in which the wagering game units are hardware components, the activation controller 206 can activate the units by making them available to receive communications and perform gaming operations. The activation controller 206 can deactivate hardware units by making them unavailable for use by other components in the wagering game server. For embodiments in which the wagering game units include software components, the activation controller 206 can activate the units by integrating them with processing resources, such as main memory and a processor. Once integrated, the wagering game units can perform gaming operations, as described herein. The activation controller 206 can deactivate the units by reclaiming the processing resources (e.g., revoking access to a processor, evicting the units from main memory, etc.).

The terminal manager 208 can include lists of available terminals, games that are available on each terminal, terminal configurations, and more. In some embodiments, the activation controller 206 uses the terminal manager's information to activate and deactivate wagering game units.

Figure 4A:
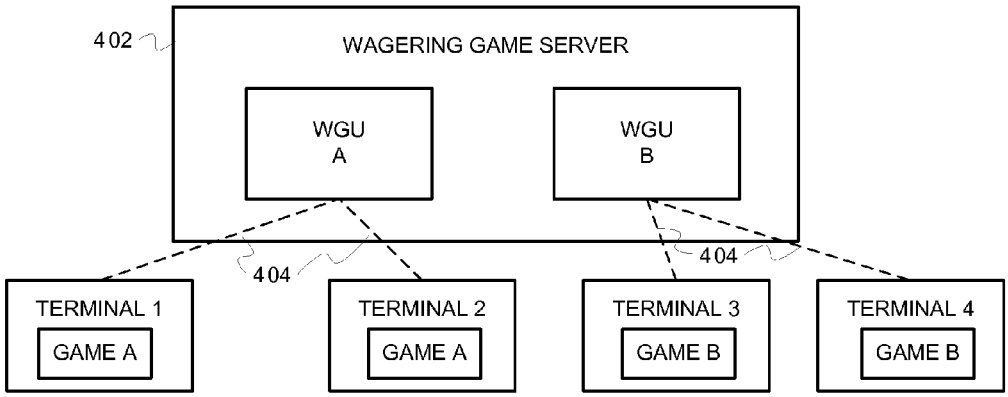
FIGS. 4A-4C are conceptual diagrams showing how a wagering game server interacts with terminals when activating and deactivating wagering game units.
Figure 4B:
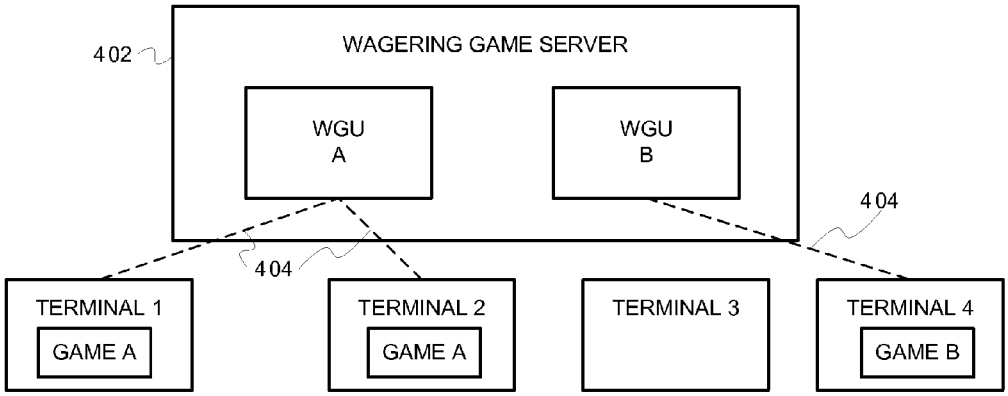
Figure 4C:
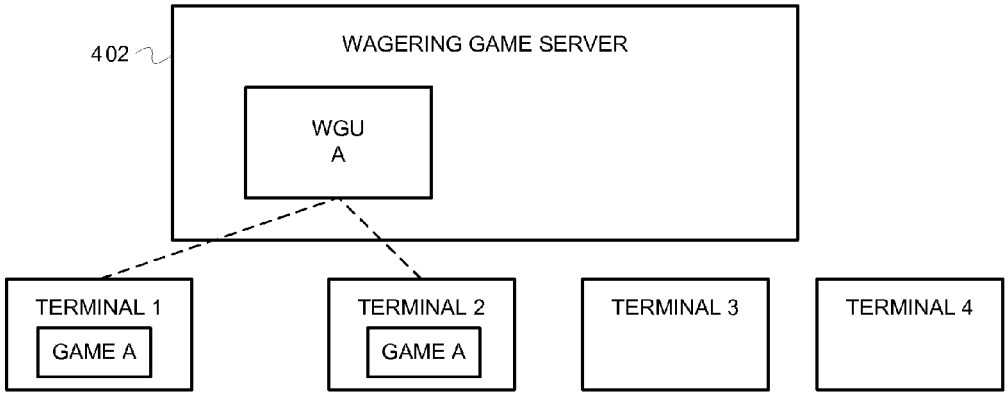

FIGS. 4A-4C are conceptual diagrams showing how a wagering game server interacts with terminals when activating and deactivating wagering game units. In FIG. 4A, a wagering game server 402 has activated wagering game units ("WGUs") A & B. In some embodiments, the server can activate the WGUs according to the operations of FIGS. 5 & 6 (described below).

In FIG. 4A, the server 402 has configured WGU A to present game A (e.g., slots) on terminals 1 & 2 (represented by dotted lines 404). Additionally, the server has configured WGU B to present game B (e.g., video poker) on terminals 3 & 4. As noted above, the server 402 can determine conditions that when satisfied cause deactivation of the WGUs.

In some embodiments, the server 402 begins deactivating a WGU upon detecting a deactivation trigger (e.g., a user selected condition). Before the server 402 can completely deactivate a WGU, it makes the WGU's game unavailable on all terminals. In some embodiments, the server 402 makes the game unavailable only after detecting a particular event or condition at the terminal. In FIG. 4B, after detecting the event/condition, the server 402 has made game B unavailable on terminal 3 (dotted line removed). After the server 402 detects the event/condition at terminal 4, it will make game B unavailable at terminal 4. Although FIG. 4B shows the server discontinuing game B on only two WGUs, it can perform the process for any number of WGUs.

FIG. 4C shows the server 402 completing the deactivating process. After making game B unavailable at the terminals, the server 402 evicts WGU B from memory or otherwise renders WGU B non-functional. Although FIGS. 4A-4C shows deactivating games, servers can activate games during different stages of the deactivation process. For example, after making game B unavailable on terminal 3 (but before deactivating WGU B), the server 402 can make a different game available on terminal 3. Thus, servers can streamline the process of swapping games on terminals.

Example Operations

This section describes operations associated with some embodiments of the invention. In the discussion below, the flow diagrams will be described with reference to the block diagrams presented above. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in any flow diagram.

Figure 5:
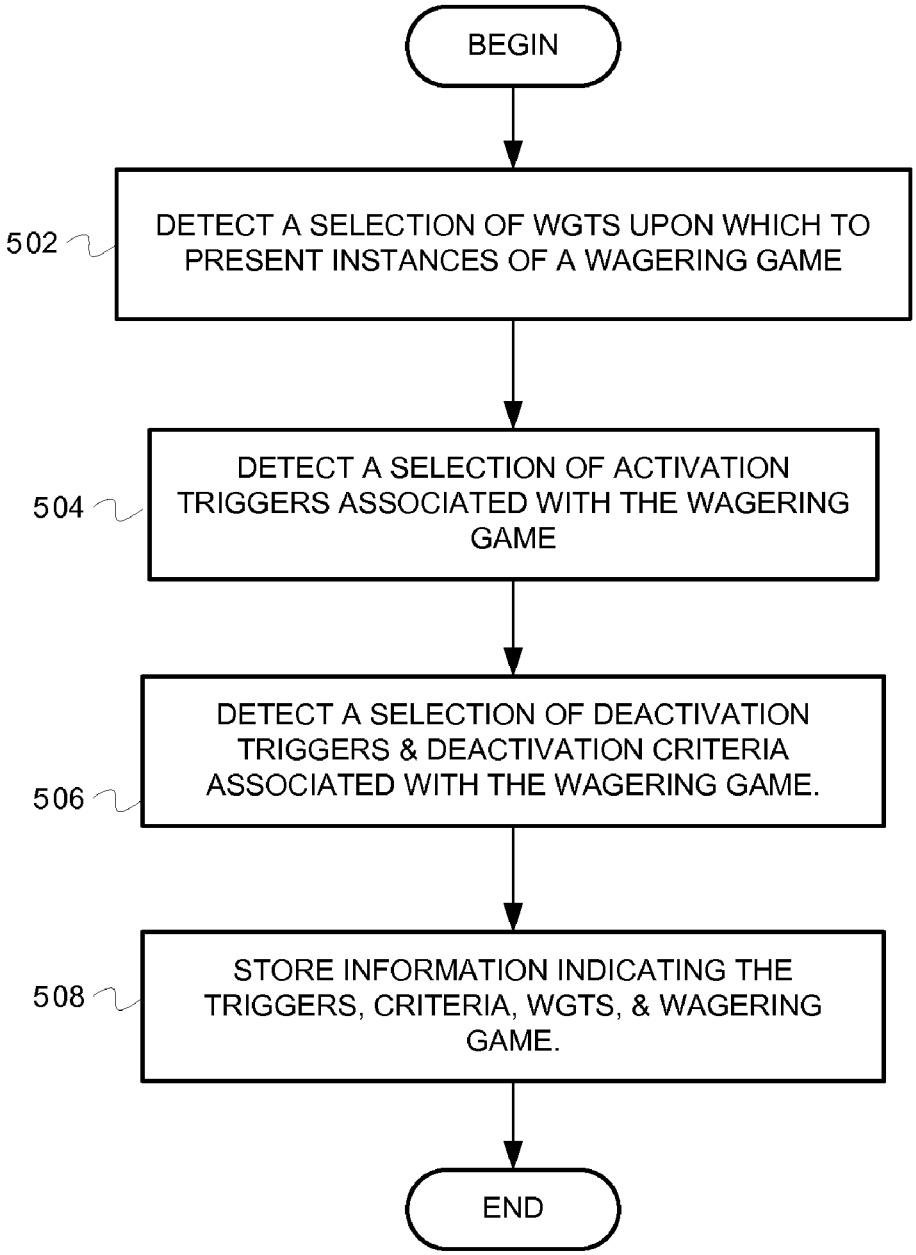
FIG. 5 is a flow diagram illustrating operations for determining parameters for activating and deactivating wagering game units, according to some embodiments of the invention.

FIG. 5 is a flow diagram illustrating operations for determining parameters for activating and deactivating wagering game units, according to some embodiments of the invention. The flow 500 begins at block 502.

At block 502, a wagering game server's gaming coordinator detects selection of a wagering game and wagering game terminals upon which the wagering game will be presented. In some embodiments, the gaming coordinator's user interface controller receives the selection through the interface shown in FIG. 3A. Alternatively, the gaming coordinator can receive the selection from elsewhere, such as from other devices on the wagering game network, via e-mail, etc. The flow continues at block 504.

At block 504, the gaming coordinator detects a selection of activation triggers associated with the wagering game. The activation triggers can include an on-demand trigger that immediately activates a wagering game unit, a time-based trigger, player demographic triggers, etc. In some embodiments, the gaming coordinator receives the activation triggers through a graphical user interface similar to that shown in FIG. 3B. In some embodiments, the gaming coordinator receives the activation triggers by other means or from other devices. Although not shown, the gaming coordinator may also detect selection of activation criteria that defines conditions at the terminals. The flow continues at block 506.

At block 506, the gaming coordinator detects selection of the deactivation triggers and deactivation criteria associated with the wagering game. The deactivation triggers can identify events or conditions that initiate a process for deactivating a wagering game unit. The deactivation criteria can identify events or conditions that must occur at the terminals before a wagering game is unavailable to the terminal. For example, a deactivation trigger may be a time of day, while deactivations criteria may indicate that terminals must be idle for a specified time before a game becomes unavailable to the terminal. The flow continues at block 508

At block 508, the gaming coordinator stores information indicating the triggers, criteria, terminals, and wagering game. The coordinator may provide some or all of this information to the terminal manager for storage. From block 508, the flow ends.

Figure 6:
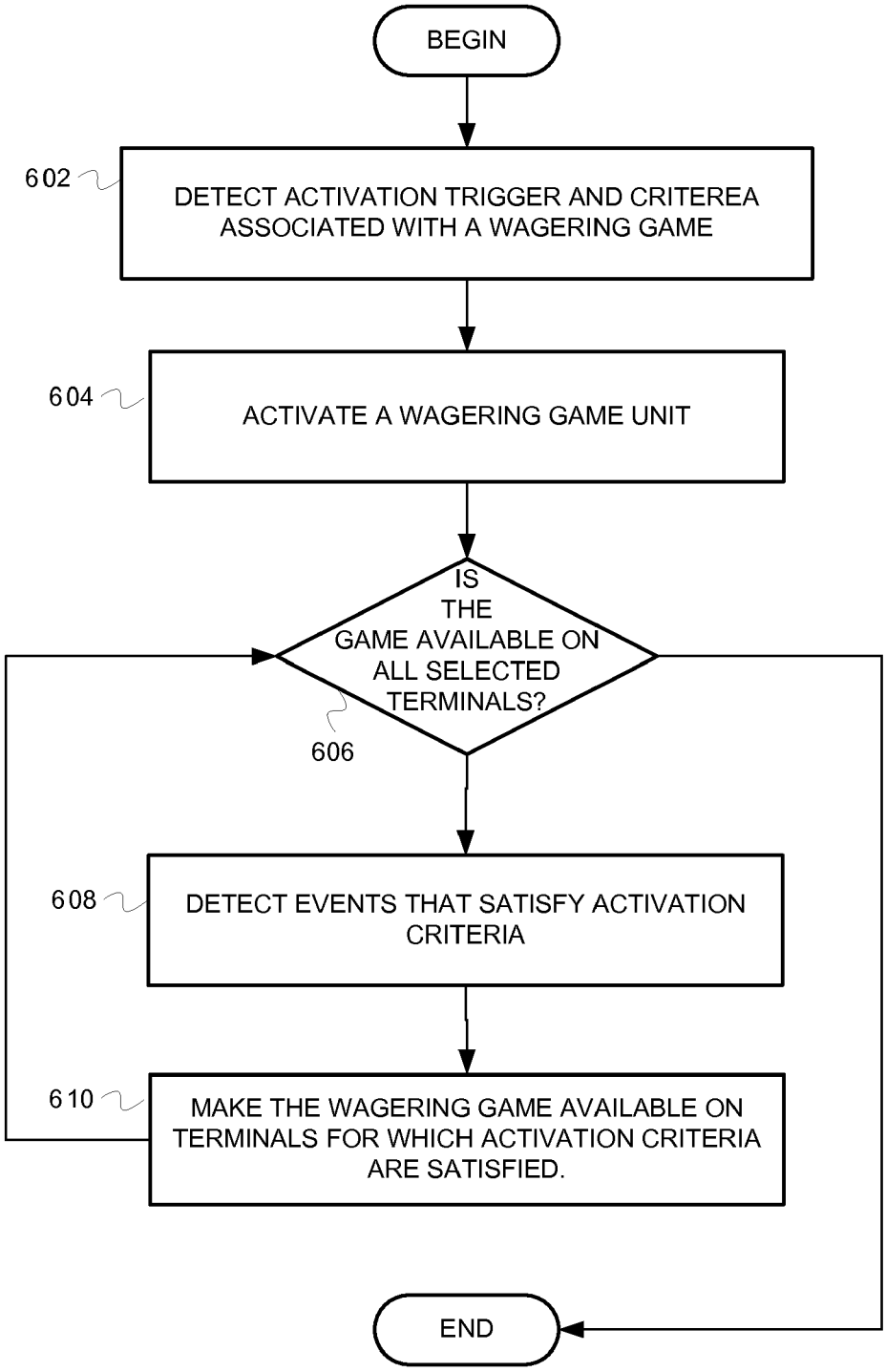
FIG. 6 is a flow diagram illustrating operations for activating a wagering game unit, according to some embodiments of the invention.

This discussion continues with a description of operations for activating wagering game units. FIG. 6 is a flow diagram illustrating operations for activating a wagering game unit, according to some embodiments of the invention. The flow 600 begins at block 602. At block 602, a wagering game server's gaming coordinator detects an activation trigger and activation criteria associated with a wagering game (e.g., a game selecting during the flow 500). For example, a trigger condition for offering a wagering game (and thereby for activating a wagering game unit) may be a time of day. In some instances, the gaming coordinator's activation controller periodically polls a system clock and determines that the activation trigger condition has been satisfied. The activation controller can poll other resources, receive notifications, and otherwise monitor for activation triggers. The gaming coordinator can also test for satisfaction of the activation criteria as described below. The flow continues at block 604.

At block 604, the gaming coordinator's activation controller activates a wagering game unit associated with a game, and offers the game on certain wagering game terminals (e.g., terminals picked during the flow 500) for which activation criteria are met. As noted above, the activation unit can activate a wagering game unit by integrating the unit's machine-readable instructions with processing resources. From block 604, the flow continues at block 606.

At block 606, the activation controller determines whether the wagering game is available at all selected terminals. If the game is available at all selected terminals, the flow ends. Otherwise, the flow continues at block 608.

At block 608, the activation controller detects events that satisfy the activation criteria. For example, the activation criteria may indicate that there must be no credits on a terminal before a wagering game becomes available. In such example, the activation controller detects that there are no credits on one or more of the selected terminals. In some embodiments, the activation criteria may enumerate one or more conditions at the wagering game server. The flow continues at block 610.

At block 610, the activation controller makes the wagering game available on the terminals for which activation criteria are satisfied. For example, the activation controller makes the wagering game available for all terminals (i.e., terminals selected to present the game) that have no credits on their credit meter. From block 610, the flow continues at block 606.

After a server activates a wagering game unit, the unit can determine game results and perform other operations that facilitate presentation of wagering games at the wagering game terminals. Later, the server can deactivate the unit.

Figure 7:
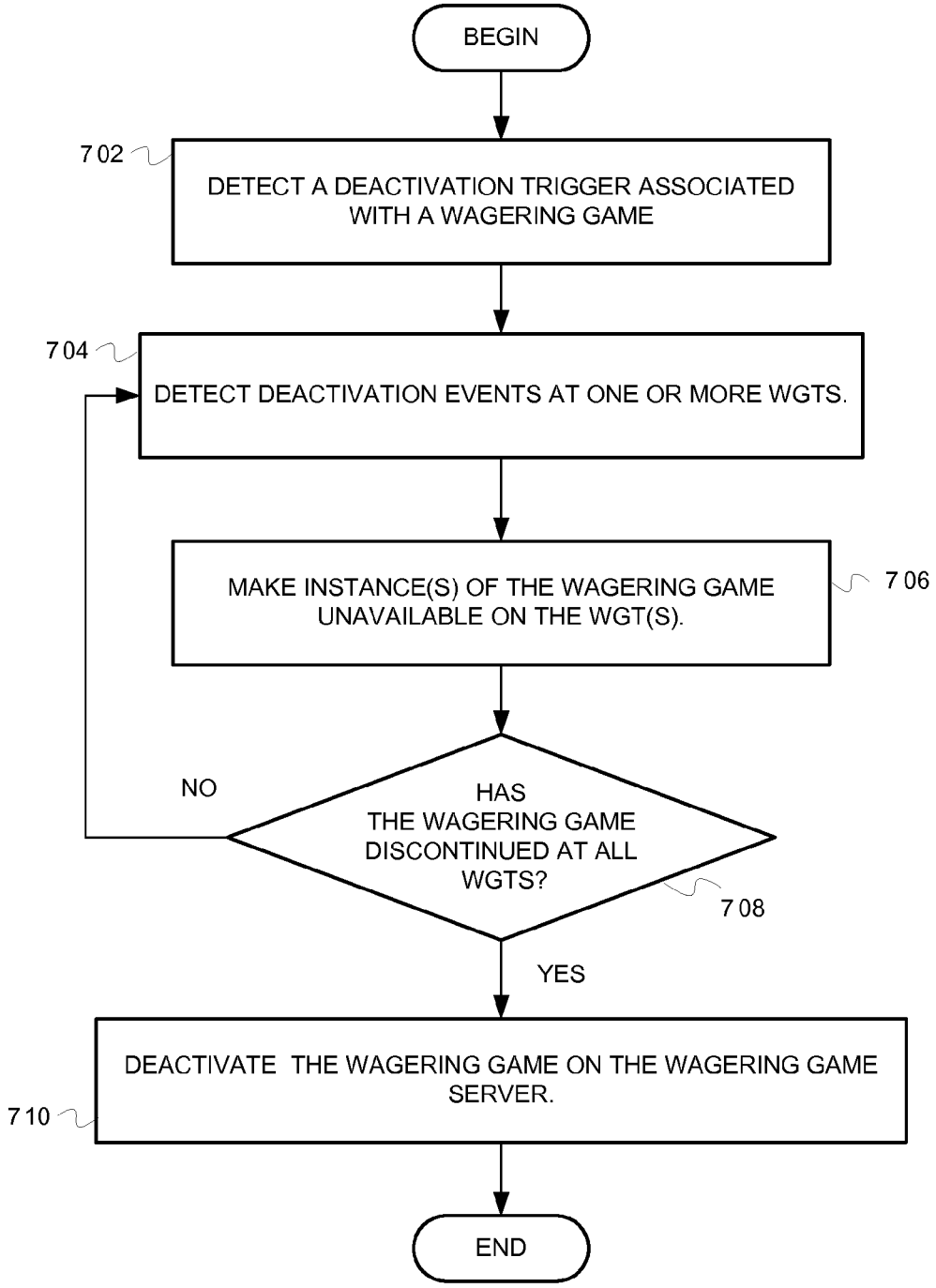
FIG. 7 is a flow diagram illustrating operations for deactivating a wagering game unit, according to embodiments of the invention.

FIG. 7 is a flow diagram illustrating operations for deactivating a wagering game unit, according to embodiments of the invention. The flow 700 begins at block 702. At block 702, a wagering game server's gaming coordinator detects a deactivation trigger associated with a wagering game. For example, the gaming coordinator's activation controller may detect that a user requested deactivation of a wagering game unit on-demand. As another example, the activation controller may determine that coin-in, player demographics, or some other parameter has reached a certain level. In some instances, the deactivation triggers are determined by performing the operations of FIG. 5. The flow continues at block 704.

At block 704, the activation controller detects deactivation events at one or more terminals. As noted above, users can select conditions that must occur before a wagering game is unavailable at each terminal. For example, a user may want each terminal to be idle for a specified time period before the server discontinues a game. The activation controller can detect when terminals have been idle for the specified time period, or when other conditions or events occur at the terminals. In some embodiments, the activation controller works in concert with a terminal manager, which detects events at the terminals. The flow continues at block 706.

At block 706, the activation controller makes the wagering game unavailable on wagering game terminals for which it detected deactivation events. In some instances, the wagering game unit(s) continue to operate on the server, but they do not communicate results and content with terminals for which deactivation events were received. The flow continues at block 708.

At block 708, the activation controller determines whether the wagering game has been discontinued at all terminals. If the activation controller has not discontinued the wagering game at all terminals, the flow continues at block 704. The flow goes back to block 704 because, in some embodiments, the game must be unavailable at all terminals before deactivating the wagering game unit on the wagering game server. If the game has been discontinued at all terminals, the flow continues at block 710.

At block 710 the activation controller deactivates the wagering game unit on the wagering game server. In some embodiments, the activation controller can deactivate the wagering game unit by revoking resources allocated to it. In other embodiments, the activation controller deactivates the wagering game unit by disconnecting its communication, stalling its processing, etc. From block 710, the flow ends.

Example Wagering Game Machines

Figure 8:
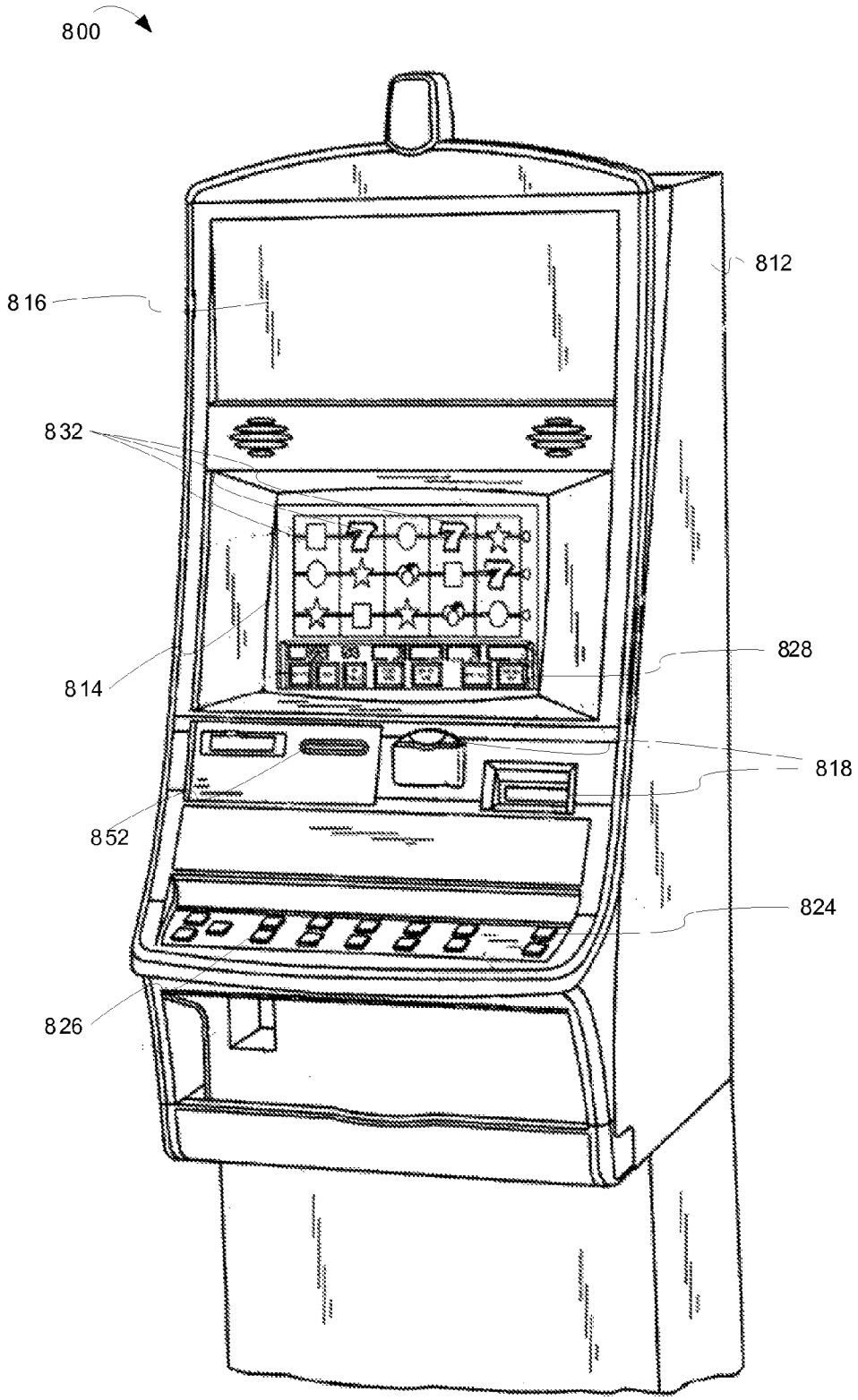
FIG. 8 is a perspective view of a wagering game machine, according to example embodiments of the invention.

FIG. 8 is a perspective view of a wagering game machine, according to example embodiments of the invention. Referring to FIG. 8, a wagering game machine 800 is used in gaming establishments, such as casinos. According to embodiments, the wagering game machine 800 can be any type of wagering game machine and can have varying structures and methods of operation. For example, the wagering game machine 800 can be an electromechanical wagering game machine configured to play mechanical slots, or it can be an electronic wagering game machine configured to play video casino games, such as blackjack, slots, keno, poker, blackjack, roulette, etc. The machine 800 can be configured as a thick, thin, or intermediate client that operates in concert with wagering game servers, as described herein.

The wagering game machine 800 comprises a housing 812 and includes input devices, including value input devices 818 and a player input device 824. For output, the wagering game machine 800 includes a primary display 814 for displaying information about a basic wagering game. The primary display 814 can also display information about a bonus wagering game and a progressive wagering game. The wagering game machine 800 also includes a secondary display 816 for displaying wagering game events, wagering game outcomes, and/or signage information. While some components of the wagering game machine 800 are described herein, numerous other elements can exist and can be used in any number or combination to create varying forms of the wagering game machine 800.

The value input devices 818 can take any suitable form and can be located on the front of the housing 812. The value input devices 818 can receive currency and/or credits inserted by a player. The value input devices 818 can include coin acceptors for receiving coin currency and bill acceptors for receiving paper currency. Furthermore, the value input devices 818 can include ticket readers or barcode scanners for reading information stored on vouchers, cards, or other tangible portable storage devices. The vouchers or cards can authorize access to central accounts, which can transfer money to the wagering game machine 800.

The player input device 824 comprises a plurality of push buttons on a button panel 826 for operating the wagering game machine 800. In addition, or alternatively, the player input device 824 can comprise a touch screen 828 mounted over the primary display 814 and/or secondary display 816.

The various components of the wagering game machine 800 can be connected directly to, or contained within, the housing 812. Alternatively, some of the wagering game machine's components can be located outside of the housing 812, while being communicatively coupled with the wagering game machine 800 using any suitable wired or wireless communication technology.

The operation of the basic wagering game can be displayed to the player on the primary display 814. The primary display 814 can also display a bonus game associated with the basic wagering game. The primary display 814 can include a cathode ray tube (CRT), a high resolution liquid crystal display (LCD), a plasma display, light emitting diodes (LEDs), or any other type of display suitable for use in the wagering game machine 800. Alternatively, the primary display 814 can include a number of mechanical reels to display the outcome. In FIG. 8, the wagering game machine 800 is an "upright" version in which the primary display 814 is oriented vertically relative to the player. Alternatively, the wagering game machine can be a "slant-top" version in which the primary display 814 is slanted at about a thirty-degree angle toward the player of the wagering game machine 800. In yet another embodiment, the wagering game machine 800 can exhibit any suitable form factor, such as a free standing model, bartop model, mobile handheld model, or workstation console model.

A player begins playing a basic wagering game by making a wager via the value input device 818. The player can initiate play by using the player input device's buttons or touch screen 828. The basic game can include arranging a plurality of symbols along a payline 832, which indicates one or more outcomes of the basic game. Such outcomes can be randomly selected in response to player input. At least one of the outcomes, which can include any variation or combination of symbols, can trigger a bonus game.

In some embodiments, the wagering game machine 800 can also include an information reader 852, which can include a card reader, ticket reader, bar code scanner, RFID transceiver, or computer readable storage medium interface. In some embodiments, the information reader 852 can be used to award complimentary services, restore game assets, track player habits, etc.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A computer-implemented method for managing computerized wagering games in a wagering game network, the method comprising:

selecting a group of wagering game terminals on which to present wagering games;

activating, in a wagering game server, a wagering game unit to present the wagering games on the wagering game terminals;

determining at least one event that must occur at each of the wagering game terminals before the wagering games will cease presentation;

detecting, in the wagering game server, user input indicating a request to deactivate the wagering game unit;

determining, after the detecting the user input, that the at least one event occurred at certain of the wagering game terminals;

ceasing presentation of the wagering games on the certain of the wagering game terminals;

determining that the at least one event occurred at others of the wagering game terminals;

ceasing presentation of the wagering games on the others of the wagering game terminals;

deactivating, on the wagering game server, the wagering game unit, wherein the deactivating occurs after presentation of the wagering game has ceased on all the wagering game terminals.

2. The computer-implemented method of claim 1, wherein the at least one event indicates that one of the wagering game terminals has been idle for a specified time period.

3. The computer-implemented method of claim 1, wherein the at least one event indicates that one of the wagering game terminals has been idle for a specified time period and with no credits on a credit meter.

4. The computer-implemented method of claim 1, wherein the group of wagering game terminals is selected based on user input through a graphical user interface.

5. The computer-implemented method of claim 1, wherein the deactivating removes the wagering game unit from main memory in the wagering game server.

6. The computer-implemented method of claim 1, wherein the activating the wagering game unit causes the wagering game server to load the wagering game unit into main memory and to perform operations under control of the wagering game unit.

7. A wagering game server comprising:

a processor;

a random number generator configured to run on the processor and to generate random numbers for use in determining results for wagering games;

a wagering game unit configured to, when activated, determine the results for the wagering games based on the random numbers, and to provide the results to remote wagering game terminals;

a gaming coordinator including, a user interface controller configured to receive user input indicating a first event that triggers a process for deactivating the wagering game unit, the input also indicating a second event, wherein the user input does not originate at the remote wagering game terminals;

an activation controller configured to activate the wagering game unit;

commence deactivation of the wagering game unit after detection of the first event;

discontinue provision of the results for each of the terminals at which the second event is detected; and terminate operation of the wagering game unit after detection of the second event at all the terminals.

8. The apparatus of claim 7, wherein the second event is an idle time period.

9. The apparatus of claim 7, wherein the first event is user input directing immediate deactivation of the wagering game unit, a time of day, or coin-in associated with the wagering games.

10. The apparatus of claim 7, wherein the activation controller is further configured to reclaim processing resources allocated to the wagering game unit.

11. The apparatus of claim 7, wherein the activation controller is further configured to evict machine-readable instructions of the wagering game unit from a main memory.

12. A non-transitory computer-readable memory device including instructions executable by a machine, the instructions comprising:

instructions to present an interface including options for configuring a process for deactivating a wagering game unit, wherein the wagering game unit is configured to provide remote wagering game terminals with results for wagering games;

instructions to detect user input indicating selection of one or more of the options, wherein in the options indicate conditions that when satisfied trigger the process for deactivating the wagering game unit, and wherein the options specify a time of day, an idle time, and a credit meter balance;

instructions to perform the process for deactivating the wagering game unit, wherein the instructions to perform the process include, instructions to determine that one or more of the conditions have been satisfied, wherein some of the conditions are associated with activities at the wagering game terminals; and instructions to detect when the remote terminals have been idle for a time period; and instructions to, after determining that the one or more conditions have been satisfied, stop the providing of the results to the remote wagering game terminals that have been idle for the time period.

13. The non-transitory computer-readable memory device of claim 12, wherein the options further indicate another wagering game unit to activate, and wherein the instructions further comprise:

instructions to activate the other wagering game unit, wherein upon activation the other wager game unit is configured to provide results to one or more of the wagering game terminals.

14. The non-transitory computer-readable memory device medium of claim 12, wherein the instructions to perform the process for deactivating the wagering game unit include, instructions to revoke processing resources from the wagering game unit and to evict the wagering game unit from a main memory.

15. The non-transitory computer-readable memory device of claim 12, wherein the instructions to perform the process for deactivating the wagering game unit include instructions to receive approval from a regulatory authority.

16. A wagering game server comprising:

means for selecting a group of wagering game terminals on which to present wagering games;

means for activating, in a wagering game server, a wagering game unit to present the wagering games on the wagering game terminals;

means for determining at least one event that must occur at each of the wagering game terminals before the wagering games will cease presentation;

means for detecting, in the wagering game server, user input indicating a request to deactivate the wagering game unit;

means for determining, after the detecting the user input, that the at least one event occurred at certain of the wagering game terminals;

means for ceasing presentation of the wagering games on the certain of the wagering game terminals;

means for determining that the at least one event occurred at others of the wagering game terminals;

means for ceasing presentation of the wagering games on the others of the wagering game terminals;

means for deactivating, on the wagering game server, the wagering game unit, wherein the deactivating occurs after presentation of the wagering game has ceased on all the wagering game terminals.

17. The wagering game server of claim 16, wherein the at least one event indicates that one of the wagering game terminals has been idle for a specified time period.

18. The wagering game server of claim 16, wherein the at least one event indicates that one of the wagering game terminals has been idle for a specified time period and with no credits on a credit meter.

19. The wagering game server of claim 16, wherein the group of wagering game terminals is selected based on user input through a graphical user interface.

20. The wagering game server of claim 16, wherein the deactivating removes the wagering game unit from main memory in the wagering game server.

* * * * *